US010265842B2

(12) United States Patent
Fowler

(10) Patent No.: US 10,265,842 B2
(45) Date of Patent: Apr. 23, 2019

(54) HANDHELD POWER TOOL

(71) Applicant: Robert Fowler, Somerset (GB)

(72) Inventor: Robert Fowler, Somerset (GB)

( * ) Notice: Subject to any disclaimer, the term of this patent is extended or adjusted under 35 U.S.C. 154(b) by 387 days.

(21) Appl. No.: 15/032,498

(22) PCT Filed: Oct. 31, 2014

(86) PCT No.: PCT/GB2014/053248
§ 371 (c)(1),
(2) Date: Apr. 27, 2016

(87) PCT Pub. No.: WO2015/063504
PCT Pub. Date: May 7, 2015

(65) Prior Publication Data

US 2016/0250741 A1 Sep. 1, 2016

(30) Foreign Application Priority Data

Nov. 1, 2013 (GB) ..... 1319348.7

(51) Int. Cl.
*B25F 3/00* (2006.01)
*B25F 5/02* (2006.01)

(52) U.S. Cl.
CPC . *B25F 3/00* (2013.01); *B25F 5/02* (2013.01)

(58) Field of Classification Search
CPC ... B25F 3/00; B25F 5/03; B23Q 5/045; B23B 2251/02; B25B 21/00; B25D 1/00
(Continued)

(56) References Cited

U.S. PATENT DOCUMENTS 5,033,552 A * 7/1991 Hu ..... B25B 21/00 173/170
7,021,399 B2 * 4/2006 Driessen ..... B25F 3/00 173/216

(Continued)

FOREIGN PATENT DOCUMENTS

CN 102205533 A 10/2011
EP 1 132 176 A1 9/2001

(Continued)

OTHER PUBLICATIONS

International Search Report and Written Opinion of the International Searching Authority, PCT/GB2014/053248, dated Jan. 20, 2015.

(Continued)

*Primary Examiner* — Nathaniel C Chukwurah
(74) *Attorney, Agent, or Firm* — Reichel Stohry LLP; Natalie J. Dean; Mark C. Reichel

(57) ABSTRACT

Handheld power tools may be manufactured for one type of use or may be multi-purpose in that different tools may be attached to them, each driven by the same motor. The point of connection between the handle and the tool is potentially weak. This connection is strengthened by providing a handheld power tool (10) comprising a handle (30), the handle including a motor (45), a drive shaft (100), and an attachment mechanism arranged for attaching various interchangeable tools (20) onto the handle for being driven by said motor, the drive shaft including, at one longitudinal end, a first rotational connection means (120) for engagement with a second rotational connection means (130) provided on each of the various tools, wherein the power tool is configured for the sliding, of the various tools onto the handle, in a direction substantially non-parallel to the rotational axis of the first connection means.

20 Claims, 3 Drawing Sheets

(58) Field of Classification Search
USPC ..... 173/47, 170, 171, 172, 2, 4; 227/8, 130, 227/131
See application file for complete search history.

(56) References Cited

U.S. PATENT DOCUMENTS

| | | | | |
|---|---|---|---|---|
| 2004/0029508 | A1* | 2/2004 | Robson | B23D 49/162 451/358 |
| 2010/0252295 | A1* | 10/2010 | Schroeder | B25F 5/02 173/217 |
| 2011/0272172 | A1* | 11/2011 | Lau | B25F 3/00 173/170 |
| 2013/0020106 | A1 | 1/2013 | Kuehne et al. | |
| 2013/0025900 | A1* | 1/2013 | Kokinelis | B25F 5/02 173/216 |

FOREIGN PATENT DOCUMENTS

| | | | |
|---|---|---|---|
| EP | 2 548 702 | A2 | 1/2013 |
| EP | 2 639 015 | A2 | 9/2013 |
| WO | WO 92/20491 | A1 | 11/1992 |
| WO | WO 2007/056172 | A1 | 5/2007 |
| WO | WO 2008/041207 | A1 | 4/2008 |
| WO | WO 2011/103636 | A1 | 9/2011 |
| WO | WO 2013/026083 | A1 | 2/2013 |

OTHER PUBLICATIONS

United Kingdom Intellectual Property Office Patents Act 1977: Search Report Under Section 17(5), GB1319348.7, dated Mar. 20, 2014.

* cited by examiner

HANDHELD POWER TOOL

PRIORITY

The present application is related to, and claims the priority benefit of, and is a 35 U.S.C. 371 national stage application of, International Patent Application Serial No. PCT/GB2014/053248, filed Oct. 31, 2014, which is related to, and claims the priority benefit of, Great Britain Patent Application Serial No. 1319348.7, filed Nov. 1, 2013. The contents of each of these applications are hereby incorporated by reference in their entirety into this disclosure.

BACKGROUND

The present invention relates generally to a handheld power tool and finds particular, although not necessarily exclusive, utility in portable handheld power tools.

Multi-purpose power tools are known whereby a required utility device can be attached and changed as required. For instance, AU2011213853A1 discloses a device whereby any one of the following devices may be connectable to a body portion; impact screwdriver, drilling tool, hammer, sander, saw, and light. Each tool is attached to the body portion by being placed onto the drive means in a direction parallel to the rotational axis of the drive means. The tool is then twisted relative to the body portion to lock it in place. When each tool is connected, it is attached by means of interlocking tabs and slots located around an inner perimeter of the tool. By their nature these interconnections are relatively inefficient at maintaining the attachment of a tool to a body portion if lateral forces are imposed on one or the other. Accordingly, it is desirable to be able to attach the tools to a body portion using different means so as to provide a stronger connection therebetween.

BRIEF SUMMARY

In a first aspect, the invention provides a handheld power tool comprising a handle, the handle including a motor, a drive shaft, and an attachment mechanism arranged for attaching various interchangeable tools onto the handle for being driven by said motor, the drive shaft including, at one longitudinal end, a first rotational connection means for engagement with a second rotational connection means provided on each of the various tools, wherein the power tool is configured for the sliding, of the various tools onto the handle, in a direction substantially non-parallel to the rotational axis of the first connection means.

The power tool may be configured for the sliding, of the various tools onto the handle, in a direction substantially non-parallel to the axis of the drive shaft.

The power tool may be arranged such that in the connected state the rotational axes of the first and second rotational connection means are substantially coaxial. For example, the first rotational connection means may be in the form of a cylindrical socket having teeth arranged around its inner surface. The second rotational connection means may be a corresponding cylindrical member including teeth on its outer cylindrical surface. The member may fit inside the socket such that the two sets of teeth engage such that the rotation of the first rotational connection member rotates the second connection member.

The first and second rotational connection means may also be described as first and second power transfer members.

The handheld power tool may further comprise a clutch for moving the first rotational connection means towards the handle during the attachment and removal of the various tools; the clutch controllable by a clutch control means. In this way the first rotational connection means may be at least partially retracted into the handle so that it does not impede the sliding of the tool onto the handle. It will be understood that this feature could be provided additionally, or alternatively, on the tool itself with the second rotational connection means being at least partially retractable relative to the housing of the tool. The clutch control means may also be known as a clutch control mechanism.

In the case of the retractable first rotational connection means the retraction/extension may be effected by the drive shaft including an outer collar and an inner drive member, the two being axially movable relative to one another. The outer collar, which may be substantially cylindrical, may include teeth arranged around its inner surface. The inner drive member may be a corresponding cylindrical member including teeth on its outer cylindrical surface. The member may fit inside the collar such that the two sets of teeth engage such that the rotation of the collar rotates the drive member.

The inner drive member may move axially (parallel to the rotational axis of the collar) within the collar. It may be urged by a resilient biasing member towards the exposed position where the first rotational connection means is not retracted. The biasing may be overcome by the clutch. The clutch control means may take the form of a user-operable button provided on the housing of the handle. By pressing the button, the clutch may move the inner drive member relative to the outer collar such that the first connection means is retracted allowing the tool to be attached or removed from the handle. Releasing the button allows the biasing member to urge the first rotational connection means outwardly from the handle for rotational connection with the second rotational connection means.

Other ways of retracting the first rotational connection means relative to the handle and of rotationally connecting the second rotational connection means of a fitted tool to the motor when not in the retracted position are contemplated. For instance, the clutch control means may be a resiliently biased movable connection control member located on the handle, arranged such that in use as the tool initially slides onto the handle the member is moved by the tool thus temporarily moving the first rotational connection means towards the handle and away from the tool thus allowing the tool to be fully attached to the handle.

The resiliently biased movable connection control member may have an approximate wedge shape. It may be provided on the handle and be biased to an outwardly projecting state. As the tool is introduced to the handle the tool may press against, and push down, the wedge-shape member such that it does not block the tool's path as it slides past. The movement of the wedge-shape member may be linked to the movement of the first rotational connection means such that as the wedge-shape is pushed down so is the first rotational connection means. A recess on the surface of the tool which is adjacent the top of the handle may allow the wedge-shape member to return to its outwardly projecting state when the tool has been moved into the correct position. The movement of the wedge-shape back to its outwardly projecting state may also move the first rotational connection means such that it connects with the second rotational connection means on the tool.

As the button on the handle is pressed to release the tool, the wedge shape member may be moved downwardly such that it is no longer present in the recess on the tool thus allowing the tool to be removed from the handle.

The movable connection control member may have a shape other than wedge-shaped such as partially spherical.

The drive shaft may include a first CV-type joint. For instance, the inner drive member may take the form of an at least partial sphere including engaging surfaces such that it may still rotationally engage with the outer collar even when the rotational axis of the inner drive member is non-parallel to the rotational axis of the outer collar.

Other CV-type joints may be provided alternatively or additionally between the motor and the first rotational connection means.

Also, other shapes and configurations of the outer collar and inner drive member are contemplated such as a polygonal shaped inner surface on the outer collar and a polygonal shaped outer surface on the inner drive member. For instance, the shapes may be hexagonal, frustoconical, and/or partially spherical.

The handheld power tool may be arranged such that in the connected state the first and second rotational connection means form a second CV-type joint. For instance, the second rotational connection means may be in the form of an at least partial sphere including engaging surfaces such that it may still rotationally engage with the cylindrical socket of the first rotational connection means even when the rotational axis of the second rotational connection means is non-parallel to the rotational axis of the first rotational connection means.

Other shapes and configurations of the first and second rotational connection means are contemplated such as a polygonal shaped inner surface on the cylindrical socket and a polygonal shaped outer surface on the inner member. For instance, the shapes may be hexagonal, frustoconical, and/or partially spherical.

The provision of CV joints permit reduced stress on the drivetrain during use and in the case of manufacturing tolerances.

As an alternative, the power tool may be arranged such that in the connected state the rotational axes of the first and second rotational connection means are substantially parallel and non-coaxial. For instance, the first and second rotational connection means may comprise of drive cogs which are engaged with one another in a side-by-side arrangement. The outer circumference of either one or both cogs may be rounded so that even when their rotational axes are non-parallel they still rotationally engage.

In this embodiment no movement of the first rotational connection means into the handle may be required for the tool to slide onto the handle. Therefore no clutch may be required. In this case, as the tool slides onto the handle and the wedge-shape member is depressed into the handle the first rotational connection means does not move.

The handheld power tool may further comprise a lock for locking the tool to the handle and a lock control means for releasing the tool for subsequent removal from the handle. Such a lock could be provided by a slidable tab, or a resiliently biased projection, both of which have to be moved to the unlock position by manual manipulation of the lock control means. The wedge-shape member may also be the lock in that it has a sloping surface on one side and a substantially vertical surface on the other side. The sloping surface may face the direction of motion of the tool as it slides onto the handle and the substantially vertical surface may lie on the opposite side from the sloping surface such that a recess on the underside of the tool cannot pass in the opposite removal direction without the lock/wedge-shape member being retracted at least partially into the handle.

The lock control means may also be known as a lock control mechanism.

The lock control means and the clutch control means may be the same such that the manipulation of one leads to both the first and second rotational connection means being disengaged from one another and the lock being unlocked such that the tool may be readily attached or removed from the handle. Alternatively, in one embodiment where no clutch is required the lock control means may simply operate the lock to allow the tool to be removed from the handle.

The handheld power tool may further comprise an interlock for preventing rotation of the drive shaft in the absence of an engaged tool. This interlock may be electronic and/or manual in form. For instance, it may be a switch, directly or indirectly, in the power circuit from the battery to the motor which is open in the absence of a tool and closed in the presence of a tool. It may be arranged such that it will only close with the tool correctly and fully located and engaged with the handle.

The handheld power tool may further comprise a rotational direction interlock for permitting rotation of the drive shaft in only one direction. This rotational direction interlock may be electronic and/or manual in form. For instance, it may be an electronic or electrical module included, directly or indirectly, in the power circuit from the battery to the motor. This may be required because it may be desirable to drive certain tools in only one direction.

The handheld power tool may be arranged such that a tool member of the tool is provided in front of the longitudinal end of the handle when attached thereto. In this way, the tool member, such as a screwdriver, may have its axis of rotation substantially parallel with the axis of rotation of the first rotational connection means. This arrangement also includes the situation where the tool member, such as a reciprocating saw, projects away from the handle in a direction parallel with the rotational axis of the first connection member.

Alternatively, the handheld power tool may be arranged such that a tool member of the tool is provided at the side of the longitudinal end of the handle when attached thereto. In this way, the tool member, such as a screwdriver, may have its axis of rotation non-parallel with, such as substantially perpendicular to, the axis of rotation of the first rotational connection means. This arrangement also includes the situation where the tool member, such as a reciprocating saw, projects away from the handle in a direction non-parallel with, such as substantially perpendicular to, the rotational axis of the first connection member.

The attachment mechanism may comprise one of a groove and a tongue for releasable engagement with one of a corresponding tongue and groove provided on the tool. The attachment mechanism may comprise at least two grooves or at least two tongues for releasable engagement with at least corresponding tongues and grooves provided on the tool. The tongue(s) and groove(s) may slidingly engage with one another.

The handheld power tool may further comprise a removable cover for keeping the first connection means substantially clean in a state where no tool is attached.

The handle may include a battery. Alternatively, or additionally, the handle may include battery engagement means for releasably attaching a battery thereto. The battery engagement means may be located at the longitudinal end of the handle opposite the end comprising the first rotational connection means. The battery engagement means may also be known as a battery attachment member.

The power tool may be cordless.

Alternatively, the power tool may include a power cable for transmitting power to the tool from an external source. The external source may be a battery or a 'mains' electricity supply.

The motor may include a fan for movement of air from outside the housing to inside the housing, or vice-versa, for cooling of the motor. Air may pass through vents provided in the housing.

In a second aspect, the invention provides a handheld power tool according to the first aspect and a tool attached thereto.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
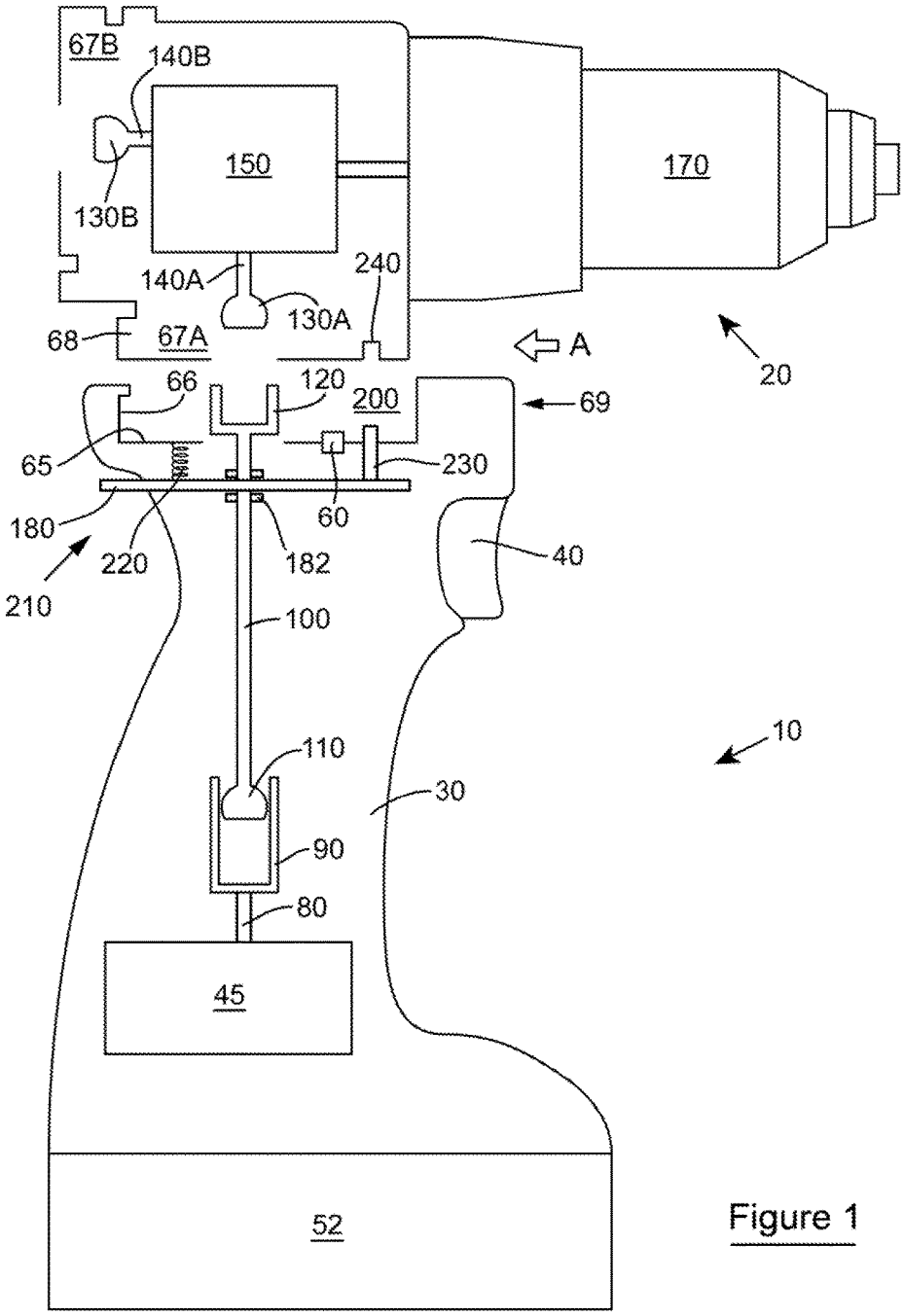
FIG. 1 is a schematic side view of a power tool and tool.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term 'comprising', used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression 'a device comprising means A and B' should not be limited to devices consisting only of components A and B. It means that with respect to the present invention, the only relevant components of the device are A and B.

Similarly, it is to be noticed that the term 'connected', used in the description, should not be interpreted as being restricted to direct connections only. Thus, the scope of the expression 'a device A connected to a device B' should not be limited to devices or systems wherein an output of device A is directly connected to an input of device B. It means that there exists a path between an output of A and an input of B which may be a path including other devices or means. 'Connected' may mean that two or more elements are either in direct physical or electrical contact, or that two or more elements are not in direct contact with each other but yet still co-operate or interact with each other.

Reference throughout this specification to 'an embodiment' or 'an aspect' means that a particular feature, structure or characteristic described in connection with the embodiment or aspect is included in at least one embodiment or aspect of the present invention. Thus, appearances of the phrases 'in one embodiment', 'in an embodiment', or 'in an aspect' in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term 'at least one' may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

A power tool 10 is shown in FIG. 1 comprising of a handle 30 about which it may be gripped by a user's hand. At the base of the handle 30 an interconnection means (or battery engagement means) (not referenced) for removably connecting a battery 52 is provided, and a battery 52 is shown in position.

Within the handle 30 a motor 45 is indicated. This is powered by the battery and controlled, in part, by a trigger 40 positioned at the front of the handle towards the top. No electrical wiring is shown in the drawings but it will be understood that appropriate wiring is provided as required.

A tool 20 is shown above the handle. This comprises of a chuck 170 for releasably holding drill bits. The tool is releasably attachable to the handle 30 as will be explained in more detail below. Other types of tool are contemplated for being fitted to the handle.

The motor 45 rotationally drives a lower drive shaft 80 which at its upper end includes a collar 90. This takes the form of a substantially cylindrical socket having teeth arranged around its inner circumferential surface. This collar 90 may be rotated in either direction by the motor 45 as required.

Within the collar 90 an inner drive member 110 is arranged with corresponding teeth on its outer circumferential surface which engage with the teeth of the collar 90. Extending upwardly away from the inner drive member 110 is an upper drive shaft 100. The inner drive member 110 is shown as being at least partially spherical such that the longitudinal orientation of the upper drive shaft may be non-parallel to the longitudinal orientation of the lower drive shaft.

At the upper end of the upper drive shaft 100 a first rotational connection means 120 is provided in the form of a substantially cylindrical socket having teeth arranged around its inner circumferential surface in a similar manner to the collar 90. The rotation of the upper drive shaft 100 rotates the first rotational connection means 120.

A clutch is provided on one side of the handle 30 and includes a projecting control tab, or button, 180. The tab 180 is movable within a portion 210 of the side of the handle 30 in an upward and downward direction. The tab extends inside, and laterally across, the handle 30. The drawing shows the tab in its uppermost position.

The tab 180 is connected to the upper drive shaft 100 by a bearing 182 such that as the tab is moved up and down so too does the upper drive shaft 100 move up and down relative to the handle 30. The bearing is optional as the shaft 100 may be biased upwards by a biasing means (or biasing member), discussed below, with the tab 180 only touching the shaft 100 when the process of disengagement is required.

The tab 180 is urged to its uppermost position by a spring 220 which is attached at one end to the tab and at the other end to the handle structure. Biasing means other than a spring are contemplated as alternatives. A biasing means may be provided in the collar 90 urging the shaft 100 upwards.

The tab 180 is depressed to lower the first rotational connection means 120 so that the tools 20 may be positioned onto the handle 30 as will be described in more detail below.

At the upper end of the handle 30 a box-like recess 200 is provided. The first rotational connection means 120 projects into this recess 200 with the tab 180 in the uppermost position. By contrast, with the tab in its lowest position the first rotational connection means 120 is withdrawn into the handle such that it does not project into the recess 200, or such that it at least does not project upwardly as much as in its uppermost position.

The tool 20 includes a base plate 67A. An opening 69 is provided in the side of the recess 200 at the front of the handle 30 to allow the base plate 67A to slide into the recess 200 in the direction indicated by arrow 'A'. A projection 68 on the leading edge of the base plate 67A engages into a corresponding recess 66 provided at the back of the recess 200 and defined by an overhanging lip. The base of the base plate 67A contacts with the upper surface 65 of the base of the recess 200.

With the tab 180 in its lowered position the first rotational contact means 120 has been moved substantially out of the recess 200 allowing the base plate 67A to move into the recess 200. The tab also controls the position of a locking member 230 which projects upwardly from the tab and out into the recess 200. With the tab 180 in its lowered position the locking member 230 is withdrawn from the recess 200. With the base plate 67A in the correct fully installed position the locking member 230 may move upwardly into a corresponding recess 240 provided in the base plate 67A. This locking member prevents the base plate 67A and thus the tool 20 from being accidentally removed or becoming dislodged during use. This locking member 230 may also act as an interlock in that if it is not in its fully extended position projecting into the socket 240 the motor will not turn.

An additional or alternative interlock 60 may be provided in the base 65 of the recess. This may be a type of contact switch connected to the motor, or a control unit provided within the handle 30 such that the absence of the tool prevents the motor turning.

With regard to the tool 20 a second rotational contact means is provided within its body in the form of an at least partially spherical member comprising teeth on its outer circumferential surface. This member is connected to a tool drive shaft 140A which, in turn, drives a gear box 150 which, in turn, drives a chuck 170.

Accordingly, with the tool 20 installed onto the handle 30 in the correct position, the tab 180 may be released such that it moves upwardly with respect to the handle 30. This moves the locking member 230 into the socket 240 and the first rotational connection means 120 into the recess 200. This first rotational connection means 120 is substantially coaxial with the second rotational connection means such that the latter fits inside the former with the two sets of teeth engaging. Thus rotation of the motor rotates the tool drive shaft 140A which via the gear box rotates the chuck 170. The chuck rotates around an axis substantially perpendicular to the rotational axis of the upper drive shaft 100.

The tool 20 includes an alternative base plate 67B at one end of the tool 20 opposite the chuck 170 and perpendicular to the base plate 67A. Accordingly, the tool 20 may be installed onto the top of the handle 30 using the alternative base plate 67B such that the chuck extends upwardly away from the top of the handle and the chuck rotates, in use, around an axis parallel to the rotational axis of the upper drive shaft 100.

An alternative second rotational connection means 130B is provided within the tool 20 to drive, via drive shaft 140B, the gear box 150. The alternative second rotational connection means 130B connects to the first rotational connection means 120 in a similar manner to the second rotational connection means 130A. The alternative base plate 67B includes all the same features as the base plate 67A.

A removable dust cover (not shown) may be provided to cover the alternative base plate 67B.

To remove the tool 20 from the handle, the tab is moved downwardly thus retracting the first rotational connection means 120 into the handle 30 such that the second rotational connection means 130A is separated from it. The locking member 230 is also retracted out of the socket 240. In this way, the tool 30 is unlocked from the handle 30 and can be removed by sliding it in the opposite direction to that shown by arrow 'A'.

Figure 2:
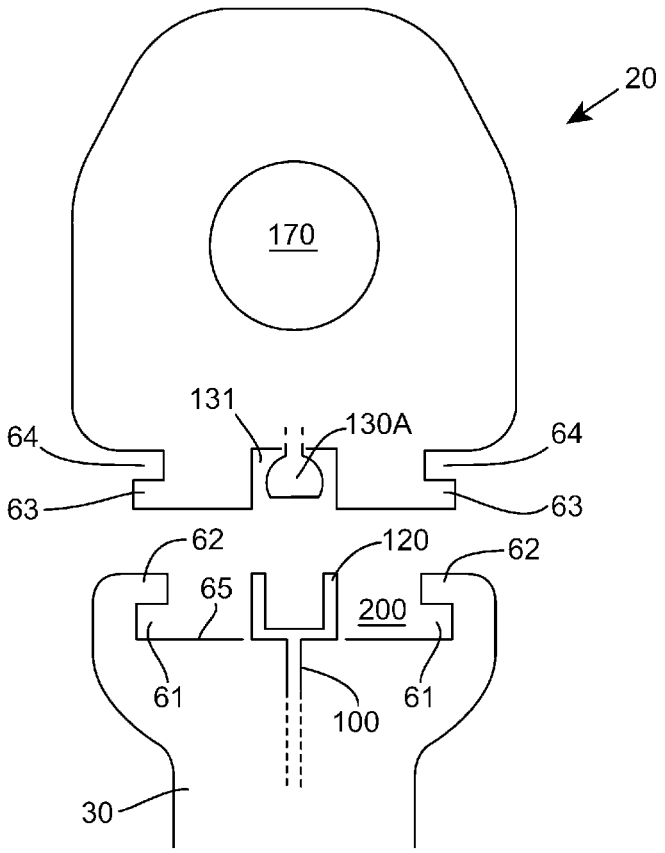
FIG. 2 is a schematic elevation of part of the power tool and tool of FIGS. 1.

In FIG. 2 the tool 20 and upper part of the handle 10 is shown looking in the direction indicated by arrow 'A' in FIG. 1. The first rotational connection means 120 is visible together with part of the upper drive shaft 100.

Part of the chuck 170 is indicated. Also, the second rotational connection means 130A is shown residing in a recess 131 within the housing of the tool 20. The base plate 67A is shown having tongues 63 located at either end with a groove 64 provided above each one, defining the tongues 63.

The recess 200 at the top of the handle 30 includes tabs 62 projecting inwardly from the upper end of either side, defining slots 61 beneath. These tabs 62 extend substantially along each side of the entire length of the recess 200. The tongues 63 on the tool 20 fit underneath these tabs 62 within the slots 61. In this way the tool 20 is rigidly attached to the handle 30 in a rectilinear manner, substantially along the entire length of contact between the tool 20 and handle 30. This type of attachment ensures that the tool 20 does not move substantially relative to the handle 30. It also provides a substantial area of contact between the tongues and grooves such that the risk of their breakage in use due to forces being placed in a non-parallel manner to the length of the slots 61 is minimal.

With the tool 20 in place on the handle 30 the first and second rotational connection means 120, 130A engage one another as described above with regard to FIG. 1 such that the motor 45 rotates the chuck 170.

Although the opening 69 has been described as being at the front of the recess 200 such that the tool 20 slides onto the handle in the direction indicated by the arrow 'A' (i.e. in the direction parallel to the rotational axis of the chuck 170), it is contemplated, as an alternative, that an opening is provided in the side of the recess 200 such that the tool 20 slides onto the handle perpendicularly to that indicated by the arrow 'A' and the rotational axis of the chuck 170. The orientation of the tongues and grooves would be shifted around by 90 degrees (around an axis parallel to the rotational axis of the drive shaft 100) to that shown and indicated but would function in the same way as before.

As described above with regard to FIG. 1, the tool 20 may be attached to the handle 30 using the alternative base plate 67B. This is not shown in FIG. 2 but it will be understood that the alternative base plate 67B slides into the recess 200 in the same manner as described with regard to the base plate 67A. Accordingly, the tool 20 may be attached to the handle 30 by the tongues 63 being retained within the slots 61.

Although not shown, in one alternative no opening 69 is provided in the front of the handle; rather, at least one gap in the tabs 62 is/are provided and the tool is presented over the gaps such that the tongues 63 may pass through the gaps. Lateral movement of the tool relative to the handle then allows for the tongues 63 to slide under the tabs 62 thus rigidly locating the tool onto the handle.

Figure 3:
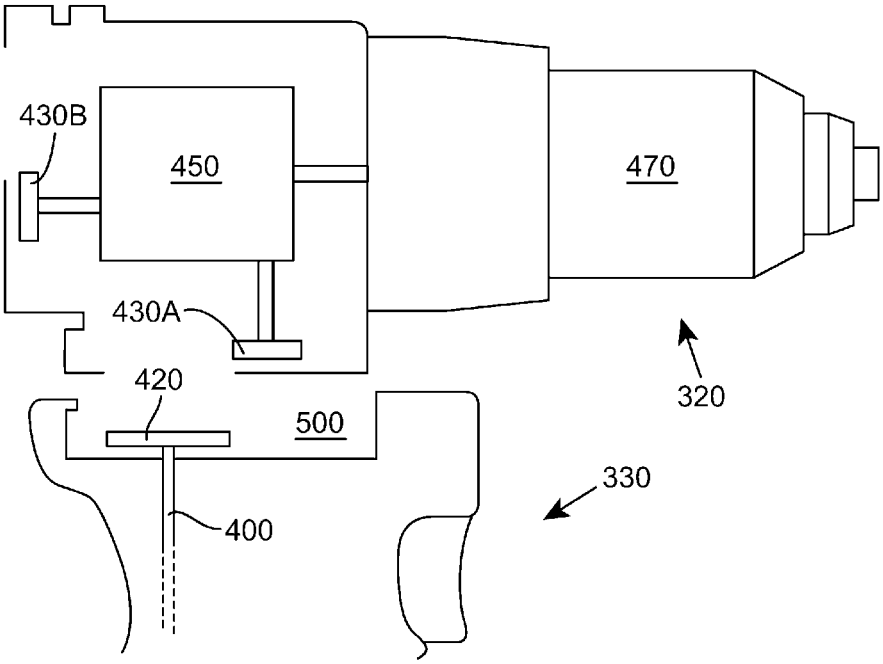
FIG. 3 is a schematic elevation of part of a different power tool and tool.

In FIG. 3, the upper part of a handle 330 of a different power tool is shown together with a different tool 320. In this version the first rotational connection means is a cog 420 which is driven by a drive shaft 400 (partially shown). The cog 420 is still arranged at the top of the handle in a recess 500. The second rotational connection means 430A is another cog which is driven by the first rotational connection means 420 effected by engagement of each of the two cogs' circumferentially arranged teeth when the tool 320 is fully attached to the handle 330. The second rotational connection means 430A drives a gear box 450 which drives the chuck 470 in a similar manner to the device shown in FIGS. 1 and 2.

In this version, it is not necessary to at least partially retract the first rotational connection means 420 into the handle 330, or to at least partially retract the second rotational connection means 430A into the tool 320 because the tool's cog 430A meets the handle's cog 420 only as the tool 320 is slidably engaged with the handle 330. The rotational axes of the two cogs are parallel but not coaxial.

In this way, a clutch is not required. However, the drive shaft 400 may still include a CV joint. All other features of the device described with reference to FIGS. 1 and 2 may also be included in the version shown in FIG. 3.

The tool 320 may be attached to the handle 330 in an orientation perpendicular to the one depicted in FIG. 3. In this way, an alternative cog 430B engages with the cog 420. The rotational axis of the chuck 470 is thus parallel with the rotational axis of the drive shaft 400 and the longitudinal length of the handle 330.

Although not shown, other tools may be releasably attached to the handle 30 such as reciprocating saws, hammers, sanders and the like.

Although tongues and grooves are described it is contemplated that other types of linear connection between the tools and the handle could be provided. For example, rails and open-sided, 'C' shape, rail attachment members could be used.

The term 'non-parallel' may include an angle in a range of 20 and 160 degrees away from the axis in question. This range may be between 30 and 150 degrees, or between 40 and 140 degrees, or between 50 and 130 degrees, or between 60 and 120 degrees, or between 70 and 110 degrees, or between 80 and 120 degrees. It may be substantially perpendicular.

The invention claimed is:

1. A handheld power tool comprising a handle, the handle including a motor, a drive shaft, and an attachment mechanism, comprising one of a groove and a tongue, arranged for attaching various interchangeable tools onto the handle for being driven by said motor, the drive shaft including, at one longitudinal end, a first rotational connector for engagement with a second rotational connector provided on each of the various tools, wherein the power tool is configured for the sliding, of the various tools onto the handle, in a direction substantially non-parallel to the rotational axis of the first rotational connector.

2. The handheld power tool of claim 1, further comprising a clutch for moving the first rotational connector towards the handle during the attachment and removal of the various tools; the clutch controllable by a clutch controller.

3. The handheld power tool of claim 2, wherein the clutch controller is a user-operable button provided on the handle.

4. The handheld power tool of claim 2, wherein the clutch controller is a resiliently biased movable member located on the handle, arranged such that in use as the tool initially slides onto the handle the resiliently biased movable member is moved by the tool thus temporarily moving the first rotational connector towards the handle and away from the tool thus allowing the tool to be fully attached to the handle.

5. The handheld power tool of claim 4, wherein the resiliently biased movable member has an approximate wedge shape.

6. The handheld power tool of claim 2, further comprising a lock for locking the tool to the handle and a lock controller for releasing the tool for subsequent removal from the handle.

7. The handheld power tool of claim 6, when dependent directly or indirectly on claim 2, wherein the lock controller and the clutch controller are the same.

8. The handheld power tool of claim 1, wherein the drive shaft includes an outer collar and an inner drive member, the outer collar and the inner drive member being axially movable relative to one another.

9. The handheld power tool of claim 1, wherein the drive shaft includes a first CV-type joint.

10. The handheld power tool of claim 1, being arranged such that in the connected state the first and second rotational connectors form a second CV-type joint.

11. The handheld power tool of claim 10, being arranged such that in the connected state the rotational axes of the first and second rotational connectors are substantially coaxial.

12. The handheld power tool of claim 1, being arranged such that in the connected state the rotational axes of the first and second rotational connectors are substantially parallel and non-coaxial.

13. The handheld power tool of claim 1, further comprising an interlock for preventing rotation of the drive shaft in the absence of an engaged tool.

14. The handheld power tool of claim 1, being arranged such that a tool member of the tool is either provided in front of the longitudinal end of the handle when attached thereto, or is provided at the side of the longitudinal end of the handle when attached thereto.

15. The handheld power tool of claim 1, wherein the attachment mechanism comprises one of a groove and a tongue for releasable engagement with one of a corresponding tongue and groove provided on the tool.

16. The handheld power tool of claim 15, wherein the attachment mechanism comprises at least two grooves or at least two tongues for releasable engagement with at least corresponding tongues and grooves provided on the tool.

17. The handheld power tool of claim 1, further comprising a removable cover for keeping the first rotational connector substantially clean in a state where no tool is attached.

18. The handheld power tool of claim 1, wherein the handle includes a battery.

19. The handheld power tool of claim 1, wherein the handle includes a battery attachment member for releasably attaching a battery thereto.

20. A handheld power tool according to claim 1 and a tool attached thereto.

* * * * *